US009630401B2

(12) United States Patent
Clippingdale et al.

(10) Patent No.: US 9,630,401 B2
(45) Date of Patent: Apr. 25, 2017

(54) PRINTHEAD CALIBRATION AND PRINTING

(71) Applicant: TONEJET LIMITED, Royston, Hertfordshire (GB)

(72) Inventors: Andrew John Clippingdale, Royston (GB); Peter James Brown, Royston (GB); Ewan Hendrik Conradie, Royston (GB); Ammar Lecheheb, Royston (GB); John Lawton Sharp, Royston (GB); Robin Timothy Bacon, Royston (GB)

(73) Assignee: Tonejet Limited, Royston, Hertfordshire (GB)

( * ) Notice: Subject to any disclaimer, the term of this patent is extended or adjusted under 35 U.S.C. 154(b) by 0 days.

(21) Appl. No.: 14/892,141

(22) PCT Filed: May 19, 2014

(86) PCT No.: PCT/EP2014/060205
§ 371 (c)(1),
(2) Date: Nov. 18, 2015

(87) PCT Pub. No.: WO2014/187764
PCT Pub. Date: Nov. 27, 2014

(65) Prior Publication Data

US 2016/0114578 A1 Apr. 28, 2016

(30) Foreign Application Priority Data

May 20, 2013 (EP) ..... 13168443

(51) Int. Cl.
*B41J 2/065* (2006.01)
*B41J 2/045* (2006.01)
(Continued)

(52) U.S. Cl.
CPC ..... *B41J 2/04573* (2013.01); *B41J 2/04536* (2013.01); *B41J 2/04576* (2013.01);
(Continued)

(58) Field of Classification Search
CPC ..... B41J 2/04573; B41J 2/04586; B41J 2/04536; B41J 2/04576; B41J 2/06; B41J 2/065; B41J 2/085; B41J 2/095
See application file for complete search history.

(56) References Cited

U.S. PATENT DOCUMENTS 5,512,922 A * 4/1996 Paton ..... B41J 2/14209 347/12
7,172,267 B2 2/2007 Furukawa
(Continued)

FOREIGN PATENT DOCUMENTS

EP 2 500 173 A1 9/2012
JP H10258511 A 9/1998
(Continued)

*Primary Examiner* — Julian Huffman
*Assistant Examiner* — Sharon A Polk
(74) *Attorney, Agent, or Firm* — Dickinson Wright PLLC

(57) ABSTRACT

The invention relates to a method of printing a two-dimensional bit-mapped image having a number of pixels per row, the printhead having a row of ejection channels and each ejection channel having associated ejection electrodes to which voltages are applied in use. During printing, in order to cause volumes of fluid to be ejected from selected ejection channels of the printhead for printing, voltage pulses having values of predetermined amplitude and duration as determined by respective image pixel bit values generated by a raster image processor are applied, at a given pulse period, to the electrodes of the selected ejection channels. The part of the raster image corresponding to an ejection channel is scanned to determine the number of adjacent non-printing pixel periods prior to a pixel to be printed and, immediately prior to the printing of said pixel, a voltage pulse, having a
(Continued)

value predetermined in accordance with the time, measured in units of the given pixel period, between the last pixel to be printed and said pixel to be printed, is applied to the ejection electrode.

16 Claims, 13 Drawing Sheets

(51) Int. Cl.
*B41J 2/085* (2006.01)
*B41J 2/06* (2006.01)
*B41J 2/095* (2006.01)

(52) U.S. Cl.
CPC ..... *B41J 2/04586* (2013.01); *B41J 2/06* (2013.01); *B41J 2/085* (2013.01); *B41J 2/065* (2013.01); *B41J 2/095* (2013.01)

(56) References Cited

U.S. PATENT DOCUMENTS

| | | | | |
|---|---|---|---|---|
| 2002/0085053 | A1 | 7/2002 | Kao et al. | |
| 2002/0097412 | A1* | 7/2002 | Shibata ..... | G06K 15/102 358/1.9 |
| 2005/0116994 | A1 | 6/2005 | Furukawa | |
| 2006/0181561 | A1* | 8/2006 | Takahashi ..... | B41J 29/393 347/14 |

FOREIGN PATENT DOCUMENTS

| | | |
|---|---|---|
| WO | WO 93/11866 | 6/1993 |
| WO | WO 97/27056 | 7/1997 |
| WO | WO 97/27058 | 7/1997 |
| WO | WO 98/32609 | 7/1998 |
| WO | WO 01/30576 | 5/2001 |
| WO | WO 03/101741 | 11/2003 |

* cited by examiner

| Non-printing pixels | Start posn. (µm) |
|---|---|
| 1 | 0 |
| 2 | 4 |
| 3 | 7 |
| 4 | 11 |
| 5 | 15 |
| 6 | 19 |
| 7 | 22 |
| 8 | 26 |
| 16 | 40 |
| 32 | 44 |
| 64 | 45 |
| 128 | 46 |
| 256 | 46 |
| 512 | 46 |

LUT1

| Non-printing pixels | Start delay (8-bit per pixel value) |
|---|---|
| 1 | 0 |
| 2 | 24 |
| 3 | 43 |
| 4 | 67 |
| 5 | 91 |
| 6 | 115 |
| 7 | 134 |
| 8 | 158 |
| 9 | 170 |
| 10 | 182 |
| 11 | 194 |
| 12<br>:<br>:<br>509 | 207<br>:<br>:<br>279 |
| 510 | 279 |
| 511 | 279 |
| ≥512 | 279 |

LUT2

| Printing pixels | Stop delay (8-bit per pixel value) |
|---|---|
| 1 | 0 |
| 2 | 0 |
| 3 | 7 |
| 4 | 24 |
| 5 | 60 |
| 6 | 82 |
| 7 | 92 |
| ≥8 | 96 |

Figure 18

LUT1A

| Non-printing pixels | Printhead channel number | | | | | | | | |
|---|---|---|---|---|---|---|---|---|---|
| | **1** | **2** | **3** | **…** | **200** | **201** | **…** | **255** | **256** |
| **1** | 35 | 35 | 35 | … | 0 | 0 | … | 2 | 2 |
| **2** | 59 | 59 | 59 | … | 24 | 24 | … | 26 | 26 |
| **3** | 78 | 78 | 78 | … | 43 | 43 | … | 45 | 45 |
| **4** | 102 | 102 | 102 | … | 67 | 67 | … | 69 | 69 |
| **5** | 126 | 126 | 126 | … | 91 | 91 | … | 93 | 93 |
| **6** | 150 | Start delays (8-bit per pixel value) | | | | | | | 117 |
| **7** | 169 | | | | | | | | 136 |
| **8** | 193 | | | | | | | | 160 |
| **9** | 205 | | | | | | | | 172 |
| **10** | 217 | | | | | | | | 184 |
| **11** | 229 | 229 | 229 | … | 194 | 194 | … | 196 | 196 |
| **12** | 242 | 242 | 242 | … | 207 | 207 | … | 209 | 209 |
| **:** | : | : | : | … | : | : | … | : | : |
| **:** | : | : | : | … | : | : | … | : | : |
| **509** | 314 | 314 | 314 | … | 279 | 279 | … | 281 | 281 |
| **510** | 314 | 314 | 314 | … | 279 | 279 | … | 281 | 281 |
| **511** | 314 | 314 | 314 | … | 279 | 279 | … | 281 | 281 |
| **≥512** | 314 | 314 | 314 | … | 279 | 279 | … | 281 | 281 |

PRINTHEAD CALIBRATION AND PRINTING

BACKGROUND

The present invention relates to electrostatic inkjet print technologies and, more particularly, to printheads and printers of the type such as described in WO 93/11866 and related patent specifications.

Electrostatic printers of this type eject charged solid particles dispersed in a chemically inert, insulating carrier fluid by using an applied electric field to first concentrate and then eject the solid particles. Concentration occurs because the applied electric field causes electrophoresis and the charged particles move in the electric field towards the substrate until they encounter the surface of the ink. Ejection occurs when the applied electric field creates an electrophoretic force that is large enough to overcome the surface tension. The electric field is generated by creating a potential difference between the ejection location and the substrate; this is achieved by applying voltages to electrodes at and/or surrounding the ejection location. One particular advantage of this type of print technology is the ability to print using greyscale, using control of the applied voltages to modulate the volume of ink ejected.

The location from which ejection occurs is determined by the printhead geometry and the position and shape of the electrodes that create the electric field. Typically, a printhead consists of one or more protrusions from the body of the printhead and these protrusions (also known as ejection upstands) have electrodes on their surface. The polarity of the bias applied to the electrodes is the same as the polarity of the charged particle so that the direction of the electrophoretic force is towards the substrate. Further, the overall geometry of the printhead structure and the position of the electrodes are designed such that concentration and then ejection occurs at a highly localised region around the tip of the protrusions.

To operate reliably, the ink is arranged to flow past the ejection location continuously in order to replenish the particles that have been ejected. To enable this flow the ink must be of a low viscosity, typically a few centipoise. The material that is ejected is more viscous because of the concentration of particles; as a result, the technology can be used to print onto non-absorbing substrates because the material will not spread significantly upon impact.

Various printhead designs have been described in the prior art, such as those in WO 93/11866, WO 97/27058, WO 97/27056, WO 98/32609, WO 01/30576 and WO 03/101741, all of which relate to the so-called Tonejet® method described in WO 93/11866.

FIG. 1 is a drawing of the tip region of an electrostatic printhead 1 of the type described in this prior art, showing several ejection upstands 2 each with a tip 21. Between each two ejection upstands is a wall 3, also called a cheek, which defines the boundary of each ejection cell 5. In each cell, ink flows in the two pathways 4, one on each side of the ejection upstand 2 and in use the ink meniscus is pinned between the top of the cheeks and the top of the ejection upstand. In this geometry the positive direction of the z-axis is defined as pointing from the substrate towards the printhead, the x-axis points along the line of the tips of the ejection upstands and the y-axis is perpendicular to these.

FIG. 2 is a schematic diagram in the x-z plane of a single ejection cell 5 in the same printhead 1, looking along the y-axis taking a slice through the middle of the tips of the upstands 2. This figure shows the cheeks 3, the ejection upstand 2, which defines the position of the ejection location 6, the ink pathways 4, the location of the ejection electrodes 7 and the position of the ink meniscus 8. The solid arrow 9 shows the ejection direction and also points towards the substrate. Each upstand 2 and its associated electrodes and ink pathways effectively forms an ejection channel. Typically, the pitch between the ejection channels is 168 μm (this provides a print density of 150 dpi). In the example shown in FIG. 2 the ink usually flows into the page, away from the reader.

FIG. 3 is a schematic diagram of the same printhead 1 in the y-z plane showing a side-on view of an ejection upstand along the x-axis. This figure shows the ejection upstand 2, the location of the electrode 7 on the upstand and a component known as an intermediate electrode (10). The intermediate electrode 10 is a structure that has electrodes 101, on its inner face (and sometimes over its entire surface), that in use are biased to a different potential from that of the ejection electrodes 7 on the ejection upstands 2. The intermediate electrode 10 may be patterned so that each ejection upstand 2 has an electrode facing it that can be individually addressed, or it can be uniformly metallised such that the whole surface of the intermediate electrode 10 is held at a constant bias. The intermediate electrode 10 acts as an electrostatic shield by screening the ejection channel from external electric fields and allows the electric field at the ejection location 6 to be carefully controlled.

The solid arrow 11 shows the ejection direction and again points in the direction of the substrate. In FIG. 3 the ink usually flows from left to right.

In operation, it is usual to hold the substrate at ground (0 V), and apply a voltage, $V_{IE}$, between the intermediate electrode 10 and the substrate. A further potential difference of $V_B$ is applied between the intermediate electrode 10 and the electrodes 7 on the ejection upstand 2 and the cheeks 3, such that the potential of these electrodes is $V_{IE}+V_B$. The magnitude of $V_B$ is chosen such that an electric field is generated at the ejection location 6 that concentrates the particles, but does not eject the particles. Ejection spontaneously occurs at applied biases of $V_B$ above a certain threshold voltage, $V_S$, corresponding to the electric field strength at which the electrophoretic force on the particles exactly balances the surface tension of the ink. It is therefore always the case that $V_B$ is selected to be less than $V_S$. Upon application of $V_B$, the ink meniscus moves forwards to cover more of the ejection upstand 2. To eject the concentrated particles, a further voltage pulse of amplitude $V_P$ is applied to the ejection upstand 2, such that the potential difference between the ejection upstand 2 and the intermediate electrode 10 is $V_B+V_P$. Ejection will continue for the duration of the voltage pulse. Typical values for these biases are $V_{IE}$=500 volts, $V_B$=1000 V and $V_P$=300 volts.

The voltages actually applied in use may be derived from the bit values of the individual pixels of a bit-mapped image to be printed. The bit-mapped image is created or processed using conventional design graphics software such as Adobe Photoshop and saved to memory from where the data can be output by a number of methods (parallel port, USB port, purpose-made data transfer hardware) to the printhead drive electronics, where the voltage pulses which are applied to the ejection electrodes of the printhead are generated.

One of the advantages of electrostatic printers of this type is that greyscale printing can be achieved by modulating either the duration or the amplitude of the voltage pulse. The voltage pulses may be generated such that the amplitude of individual pulses are derived from the bitmap data, or such that the pulse duration is derived from the bitmap data, or using a combination of both techniques.

To obtain high quality inkjet printing, the ejection process must be identical on each occasion, so that jet volume, jet composition, etc., are consistent. Inkjet printing is a dynamic process and the various physical processes involved each occur on characteristic timescales.

However, in certain circumstances, ejection could be delayed from the start of the voltage pulse as a result of the timescale at which ejection events may occur. The manner in which a print channel starts ejecting depending on how long it has been dormant is usually referred to its "start-up" characteristic; in the special case of a single dot or pixel this characteristic is called "drop-on-demand".

In a similar way to that in which a delay in start-up of ejection might occur at the beginning of printing after a pause or block of non-printed pixels, so a delay in turn-off could exist. The result, continued ejection after the end of a block or line of pixels, might result in uneven and lengthened ends of printed areas.

The dynamic processes involved during electrostatic printing include electrostatic and fluidic effects. Two of these dynamic processes are:

1. During operation, but when ejection is not required, a d.c. bias voltage, $V_B$, is applied to the ejection location and the ink meniscus relaxes into a stable shape, pinned to the ejection location and other features on the printhead. When a voltage pulse is applied ($V_B+V_P$), the meniscus moves forwards and ejection occurs in the manner described earlier. Once the voltage pulse has finished, the ink will relax back to its initial state, but if a subsequent pulse is applied before this relaxation has finished, the resultant ejection event will start with the meniscus in a forward and therefore more suitable position. The resultant print density will therefore be stronger than for the first ejection event.
2. The density of charged ink particles concentrated at an ejection location increases with the strength of the applied electric field. This is because the electric field causes electrophoresis that overcomes the natural propensity for the ink particles to disperse evenly (neglecting gravity) and attain a homogeneous density. Opposing this concentration effect is diffusion and the Coulombic repulsion between the like-charged particles. In a steady-state, the system will reach a concentration equilibrium characterised by a density of charged particles that is dependent on the magnitude of the applied d.c. bias $V_B$. When a voltage pulse is applied to the ejection location, the concentration of ink particles increases until the electrophoretic force on the particles overcomes the surface tension of the ink and ejection occurs. After the voltage pulse has finished, the concentration of the particles will relax towards the initial equilibrium state, driven by diffusion and Coulombic forces. If a voltage pulse is applied during the relaxation process then the ejection will start from a more favourable state of increased particle concentration and the subsequent print density will be stronger.

These processes have characteristic time-constants that are of the order of one to a few hundred microseconds. In order for the printed image to be robust against the effects of start-up and stop delay compensation can be provided via the drive voltage waveforms. Such compensation is termed 'history correction'.

Electrostatic inkjet printheads can be controlled using the duration and/or amplitude of electrical pulses to the printhead ejectors to modulate the ejection from the ejectors. Unlike piezo or thermal inkjet printheads, in which the size of droplet ejected is primarily a function of the physical dimensions of the pressure chamber and nozzle, the volume of ink ejected from an electrostatic printhead ejector can be controlled by the amplitude and/or the duration of the electric field acting on the ink in the ejector, which in turn is determined by the voltage waveform applied to the electrodes of the printhead. This enables predictable variations in the ejection performance of an ejector to be corrected by the drive waveform to the ejector.

The ways in which the drive pulse duration and amplitude can be controlled are shown schematically in FIGS. 4 & 5.

One solution to history effects is to vary the waveform of the voltage pulse as a function of the duration since the previous pulse. A way of implementing this is described in JP10258511 and is expanded upon in U.S. Pat. No. 7,172,267. These inventions describe a scheme where the duration of the pulse is increased as the duration since the previous ejection is increased. This solution works, but is difficult to implement in practice, as the controlling electronics and software must be able to cope with pulses of highly variable duration that extends to greater than the pixel period, necessitating a greater bit-depth of data specifying pulse length if resolution is not to be sacrificed, and consequently more complex electronics.

SUMMARY

According to the present invention there is provided a method of printing a two-dimensional bit-mapped image having a number of pixels per row, the printhead having a row of ejection channels, each ejection channel having associated ejection electrodes to which voltages are applied in use sufficient to cause particulate concentrations to be formed from within a body of printing fluid, and wherein, during printing, in order to cause volumes of charged particulate concentrations to be ejected as printed droplets from selected ejection channels of the printhead, voltage pulses having values of predetermined amplitude and duration as determined by respective image pixel bit values generated by a raster image processor are applied, at a given pulse period, to the electrodes of the selected ejection channels, wherein the part of the raster image corresponding to each ejection channel is scanned to determine the number of adjacent non-printing pixel periods prior to a pixel to be printed and, immediately prior to the printing of said pixel, a voltage pulse, having a value predetermined in accordance with the time, measured in units of the given pulse period, between the last pixel to be printed and said pixel to be printed, is applied to the ejection electrode.

The invention also includes a method wherein when a line of pixels is to be printed from an ejection channel in the direction of printing, normal to the direction of the row of ejection channels, the pixel bit values of a preselected number of pixels last to be printed in the line are decreased in accordance with a predetermined calibration schema.

The simpler system proposed by this method generates voltage pulses that are constrained to be no longer than the period of an image pixel, which is determined by the print frequency (the rate at which individual image pixels are printed). In this case, if the printer is operating at a frequency v, then the period is 1/v and the pulses cannot be longer than this. As explained below, electrostatic printers can generate greyscale printing by modulating the duration of the pulses within this constraint.

This scheme greatly simplifies the driving electronics and also reduces the amount of data that is required to encode the image data. Each pulse can be simply encoded as a percentage of the period required to generate the dot required by the image; for example, 256-level greyscale can be achieved by encoding each pulse within one byte (8 bits). A system that tolerates pulses that can be longer than period 1/v will either need to encode the pulse data in more bits, or reduce the resolution of greyscale achievable.

In practice, clock-pulses generated at the print frequency trigger the next set of voltage pulses. A voltage pulse may start at the beginning of the period and continue for a duration determined by the image data, but for no longer than the period. Alternatively, a pulse may start part-way through the period at a position determined by the image data and stop at the end of the period; or both the start and stop positions may be varied within the pixel period in accordance with the image data.

In this scheme, history correction is achieved by printing a 'virtual pixel' before the real pixel. This 'virtual pixel' results in a voltage pulse that is long enough to force the print system into a state that is ideal for drop-on-demand printing, but is not long enough to generate printing itself. The result is distinct, separate, non-printing pre-pulse before the main printing pulse, as described in detail below.

Preferably, the parts of the raster image corresponding to each ejection channel are scanned to determine the number of adjacent non-printing pixel periods prior to a pixel to be printed and, immediately prior to the printing of said pixel, a voltage pulse, having a value predetermined in accordance with the time, measured in units of the given pixel period, between the last pixel to be printed and said pixel to be printed, is applied to the corresponding ejection electrode.

The time duration of the voltage pulses applied immediately prior to the printing of said pixel may be limited to the pixel period or to the pulse length of said pixel.

Preferably, the predetermination of the voltage pulse values is carried out in a calibration process in which one or more printing patterns are printed, each of which contains one or more columns of pixels, comprising continuously printing pixels followed by a number of adjacent non-printing pixels followed by a further pixel or pixels, in the direction of print (P) that the printhead moves relative to the substrate and which together or individually contain a range of non-printing distances between the continuously printed pixels and the further pixel or pixels.

The or each printed pattern may be scanned and the position of the start of each of said further pixels determined or measured in relation to a datum position corresponding to the ideal or desired print position.

Alternatively, the printed pattern may be scanned and the position of the start of each said further pixels determined or measured in relation to a datum position corresponding to the ideal or desired print position for at least one channel of the printhead and estimated for the remaining channels of the printhead.

The estimation is preferably calculated from said measurement from the at least one measured channel of the printhead combined with predetermined data for the steady-state print density variation across a printhead.

An interpolation step can be carried out by interpolating between the determined or measured values to estimate the start positions for all numbers of non-printing pixels over a predetermined range.

When a continuous line of pixels is to be printed from an ejection channel in the direction of printing, normal to the direction of the row of ejection channels, the parts of the raster image corresponding to each ejection channel are preferably scanned to determine the number of adjacent printing pixel periods prior to a non-printing pixel and the pixel bit values of a preselected number of printing pulses applied to the corresponding ejection electrode, for the pixels last to be printed prior to the non-printing pixel, are reduced in dependence on the number of adjacent printing pixel periods prior to the non-printing pixel.

The reduction of the pulse value may be predetermined in a calibration process in which one or more printing patterns are printed, each of which contains one or more columns of pixels, comprising continuously printing pixels followed by a non-printing pixel, in the direction of print (P) that the printhead moves relative to the substrate, and which together or individually contain a range of printing distances.

The or each printed pattern can be scanned and the position of the end of each of said pixel last to be printed determined or measured in relation to a datum position corresponding to the ideal or desired print position.

The position data, expressed in terms of the 8-bit pulse length value of a pixel (where 0 to 255 represents a pulse of 0 to 100% of the pixel period), may be saved to memory in the form of one or more look-up tables relating the number of non-printing pixels to the subsequent start position delay in pixel length value or, respectively, relating the number of printing pixels to the subsequent stop position delay in pixel length value.

The operational printing speed may differ from the speed at which calibration patterns were printed, in which case the data held in the look-up tables is scaled before being applied to the pixels by multiplying the data values by a function of the ratio operational printing speed/calibration pattern printing speed to produce an intermediate set of values and interpolating between rows of the subsequent tables to produce replacement look-up tables having rows corresponding to integer entries which replace the rows of the original tables.

The look-up tables may be contained in memory forming part of the printhead.

The data in the look-up tables is applied to the pixels of the image to be printed.

BRIEF DESCRIPTION OF THE DRAWINGS

Examples of methods and apparatus according to the present invention will now be described with reference to the accompanying drawings, in which:

FIG. 18 illustrates a resulting modified look-up table LUT1A;

DETAILED DESCRIPTION

Before describing an example of the method according to the invention, it may be useful to describe the two methods generally usable to control the volume of droplets printed (or ejected) using the Tonejet® method.

Figure 1:
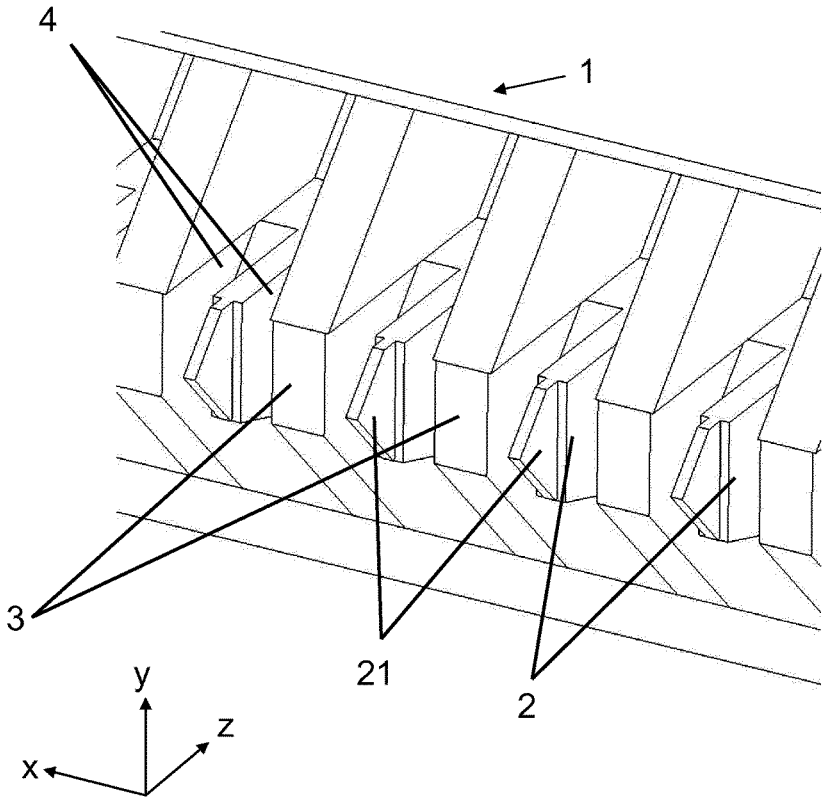
FIG. 1 is a CAD drawing showing detail of the ejection channels and ink feed pathways for an electrostatic printer.
Figure 2:
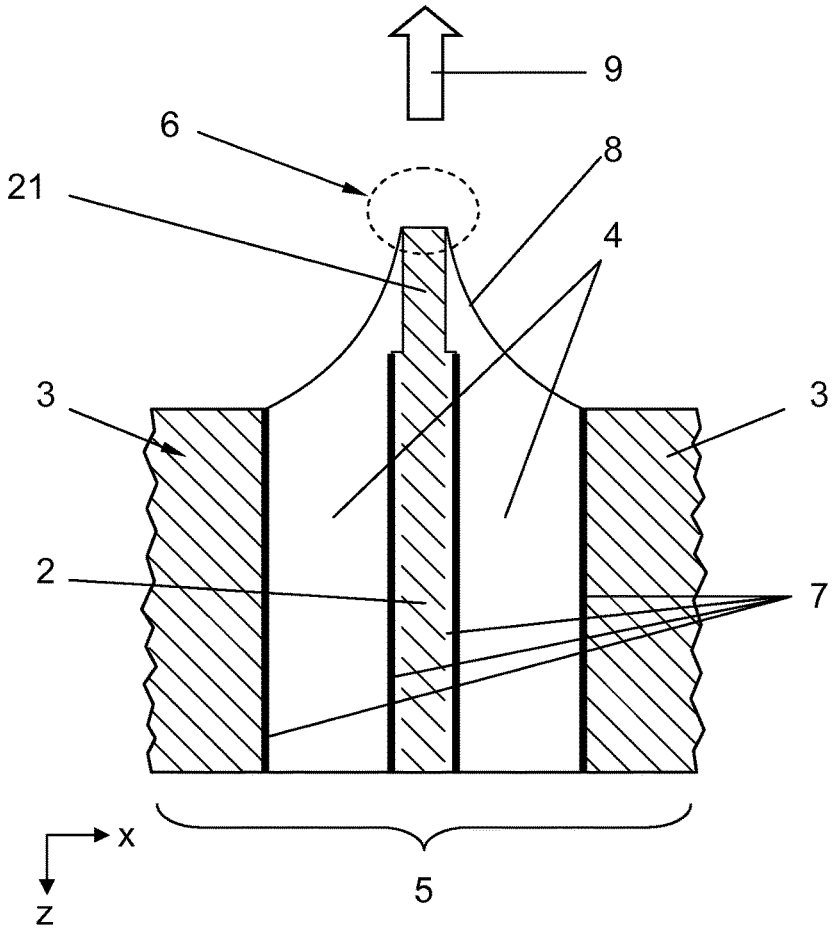
FIG. 2 is a schematic diagram in the x-z plane of the ejection channel in an electrostatic printhead of the type shown in FIG. 1.
Figure 3:
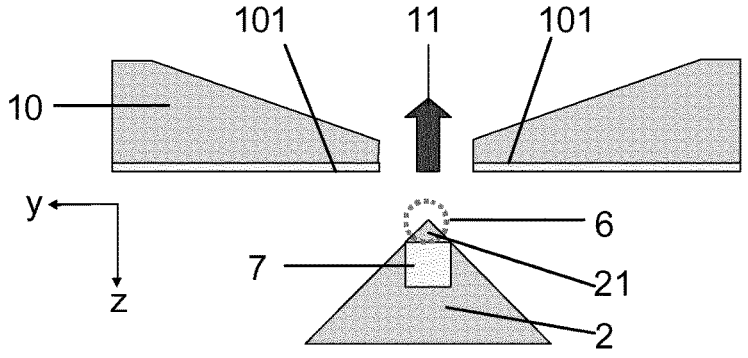
FIG. 3 is a schematic diagram in the y-z plane of the ejection channel in an electrostatic printhead of the type shown in FIG. 1.
Figure 4:
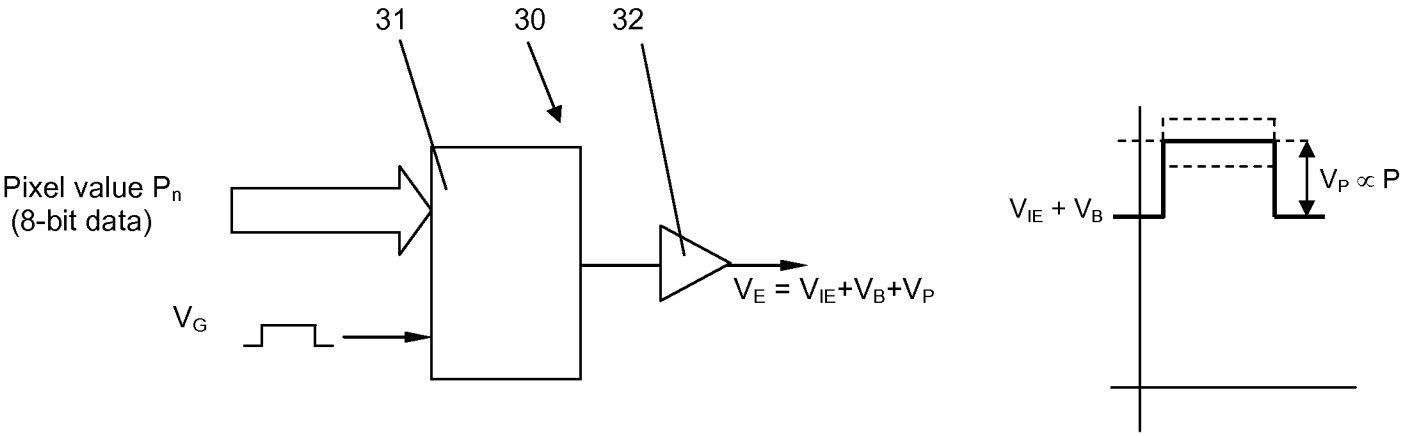
FIG. 4 is a block diagram illustrating how the amplitude of an ejection pulse can be adjusted and a related waveform diagram showing resulting illustrative adjusted amplitudes of a pulse.

FIG. 4 shows the block diagram of a circuit 30 that can be used to control the amplitude of the ejection voltage pulses $V_E$ for each ejector (upstand 2 and tip 21) of the printhead 1, whereby the value $P_n$ of the bitmap pixel to be printed (an 8-bit number, i.e having values between 0 and 255) is converted to a low-voltage amplitude by a digital-to-analogue converter 31, whose output is gated by a fixed-duration pulse $V_G$ that defines the duration of the high-voltage pulse $V_P$ to be applied to the ejector of the printhead. This low-voltage pulse is then amplified by a high-voltage linear amplifier 32 to yield the high-voltage pulse $V_P$, typically of amplitude 100 to 400V, dependent on the bit-value of the pixel, which in turn is superimposed on the bias voltages $V_B$ and $V_{IE}$ to provide the ejection pulse $V_E=V_{IE}+V_B+V_P$.

Figure 5:
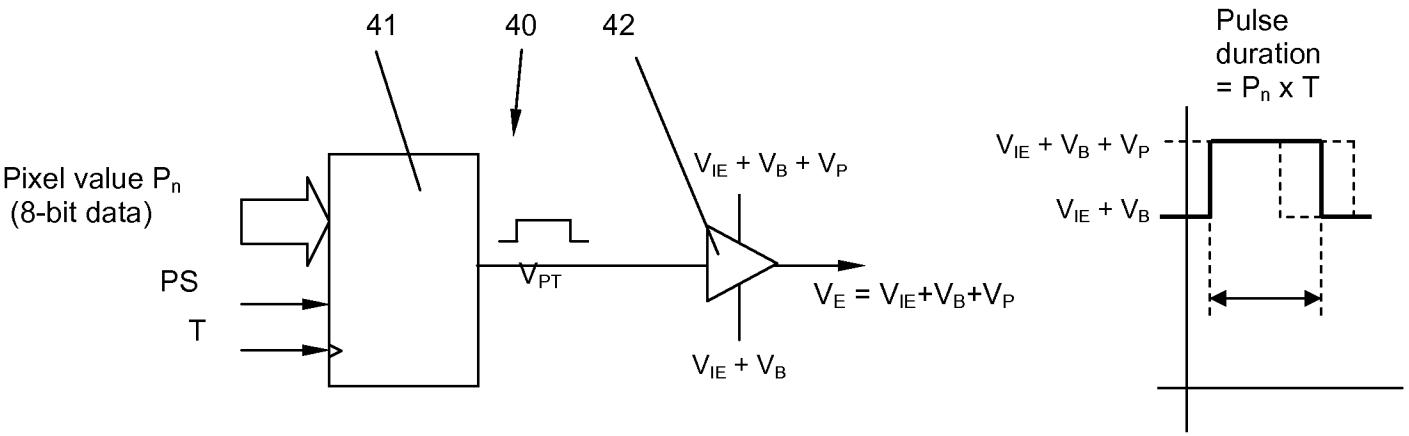
FIG. 5 is a block diagram illustrating how the duration of an ejection pulse can be adjusted and a related waveform diagram showing resulting illustrative adjusted durations of a pulse.

FIG. 5 shows the block diagram of an alternative circuit 40 that can be used to control the duration of the ejection voltage pulses $V_E$ for each ejector of the printhead 1, whereby the value $P_n$ of the bitmap pixel to be printed is loaded into a counter 41 by a transition of a "print sync" signal PS at the start of the pixel to be printed, setting the counter output high; successive cycles (of period T) of the clock input to the counter cause the count to decrement until the count reaches zero, causing the counter output to be reset low. The counter output is therefore a logic-level pulse $V_{PT}$ whose duration is proportional to the pixel value (the product of the pixel value $P_n$ and the clock period T); this pulse is then amplified by a high voltage switching circuit 42, which switches between a voltage ($V_{IE}+V_B$) when low to ($V_{IE}+V_B+V_P$) when high, thus generating the duration-controlled ejection pulse $V_E=V_{IE}+V_B+V_P$. Such a circuit can be easily adapted to generate pulses that have fixed leading edges and variable position trailing edges as described above, fixed trailing edges and variable position leading edges, or variable leading and trailing edge positions controlled in accordance with image data.

The value of $P_n$ of the bitmap pixel to be printed corresponds to a duty cycle (of the ejection pulse) between 0% and 100%. Typically, when printing at a resolution of 600 dpi and with relative motion between the print substrate (not shown) and the printhead 1 being at a speed of 1 $ms^{-1}$, this equates to a pulse length of between 0 and 42 μs on a 42 μs pulse repetition period.

Of the alternative techniques depicted in FIGS. 4 and 5, in practice it is simpler to modulate the duration of the pulse, but either technique may be appropriate in given circumstances and both may be used together.

In practice of course, a printed colour image is produced by using (say) four printheads, each of which is used to print one of the four conventional colour components (CMYK). The following description applies to each printhead, and the calibration process is repeated for each printhead. For simplicity the process is described once only.

As defined above, immediately prior to the printing of a pixel after a number of non-printing pixels, a voltage pulse, having a value predetermined in accordance with the time, measured in units of the given pulse period, between the last pixel to be printed and the pixel to be printed, is applied to the ejection electrode. In some cases the method produces multiple 'pre-pixel' voltage pulses. In order to determine the value of the compensating voltage pulse(s) for these pixel(s) a calibration process is carried out before the printhead is first used and may be repeated from time to time to maintain the highest quality of print from the printhead.

The calibration process will now be described.

Figure 6:
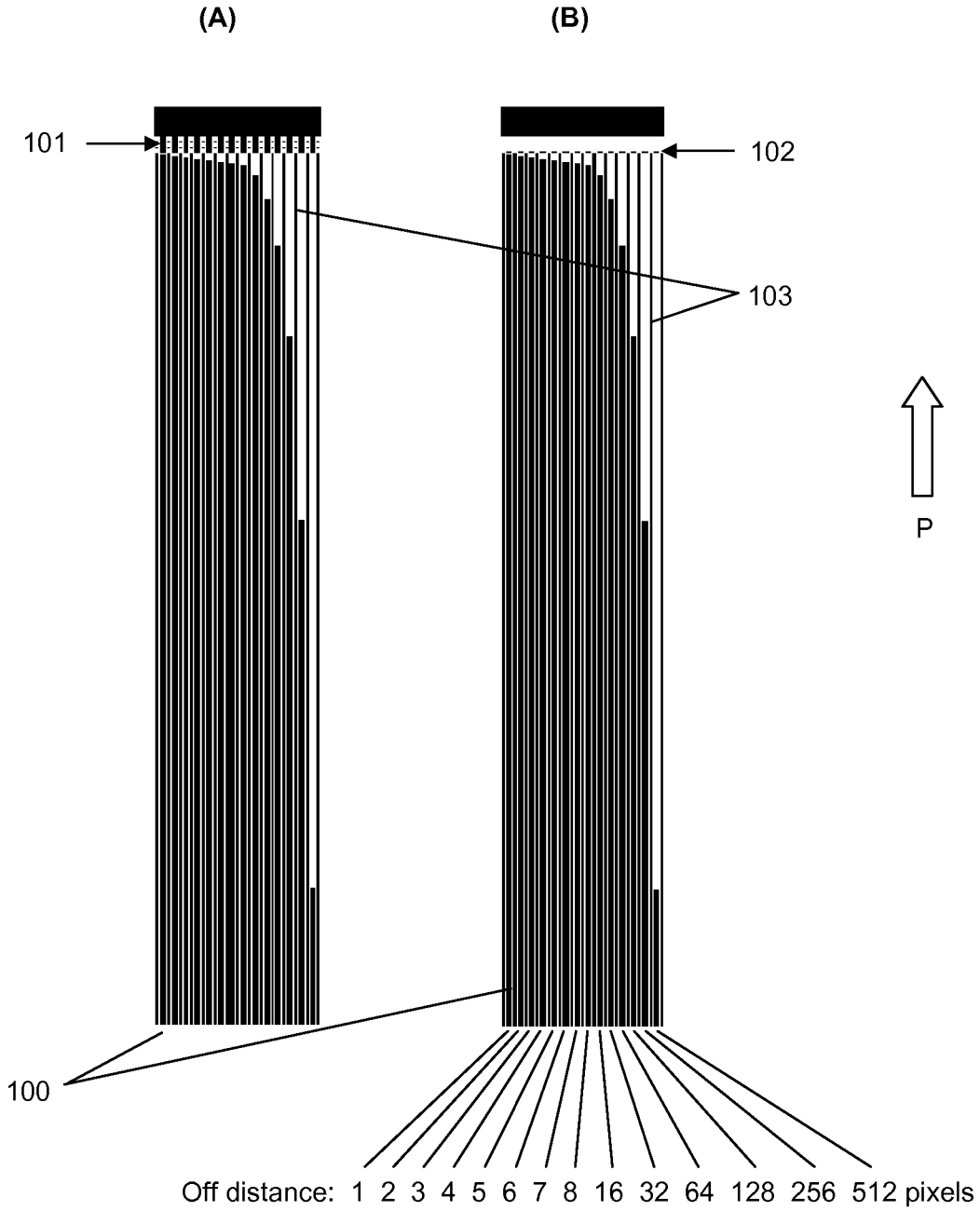
FIG. 6 illustrates examples of printing patterns for use in calibrating the compensation for delayed ejection after periods of non-printing pixels.

The calibration function is obtained for the printhead with a given ink by printing test pattern(s) that contain a range of non-printing distances prior to starting to print again. Examples of suitable patterns are shown in FIG. 6. The patterns are printed at a designated speed, usually 1 m/s, which is usually but not necessarily the same speed at which the print system will be used in subsequent operation.

The patterns A & B each comprise 14 columns of pixels 100 each four pixels wide and 600 pixels long (25.4 mm) in the direction of print P that the printhead moves relative to the substrate, spanning part of the width of the printhead, in this case 116 pixels wide (4.87 mm), each column comprising continuously printing pixels followed by a number of non-printing pixels (illustrated by the white areas above the printed part of each column 100). The number of non-printing pixels varies from left to right as shown below pattern B (only) in FIG. 6, from 1 to 512 as illustrated at the bottom of the pattern. In pattern A, following the non-printing pixels in each column a four-pixel-wide block 101 is printed 11 pixels in length. In pattern B, following the non-printing pixels in each column a four-pixel-wide line 102 of single pixels is printed. Each side of each of the 14 columns is a continuous printed line 103. The printing pixels in these patterns are printed with an 8-bit value of 255, corresponding to a print pulse length of 100% of the pixel period.

Figures 7, 8:
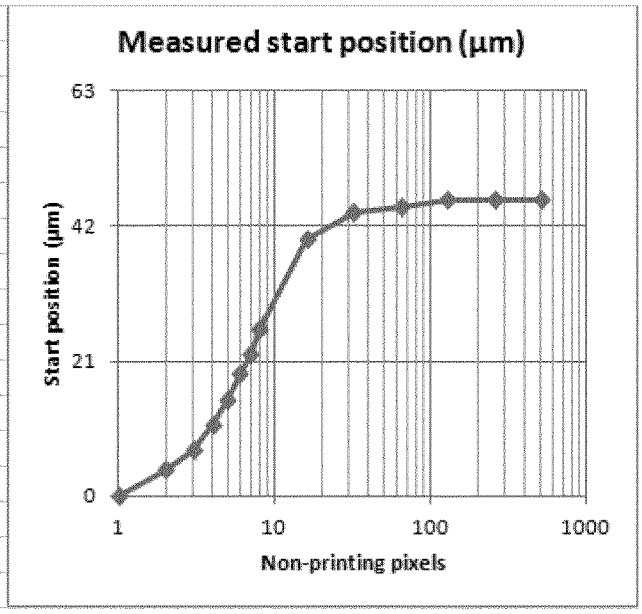
FIG. 7 is a graphical representation of the results of the measurement of delayed ejection occurring after periods of non-printing pixels.
FIG. 8 is a look-up table relating the number of non-printing pixels to the delay time.

The printed pattern A is then scanned and the position of the start of each block 101 is determined/measured in relation to a datum position corresponding to the ideal or desired print position. FIG. 7 is a graphical representation of the typical form of results of the measurement, with the numerical values of start position distance for each column being shown in the table to the left of the graph. Thereafter an interpolation step is carried out by interpolating between the measured values to estimate the start positions for all numbers of non-printing pixels from 1 to 512 pixels. A simple linear interpolation between values plotted on a logarithmic horizontal scale as in FIG. 7 is usually sufficient. The position data is then expressed in terms of the 8-bit pulse length value of a pixel (where 0 to 255 represents a pulse of 0 to 100% of the pixel period) by dividing it by the pixel pitch which is approximately 42 microns for a 600 dpi print and multiplying by 255. Start position delays that exceed a single pixel are represented by values greater than 255. The data are saved to memory in the form of a look-up table (LUT1'see FIG. 8) relating the number of non-printing pixels to the subsequent start position delay in pixel value.

Figure 9:
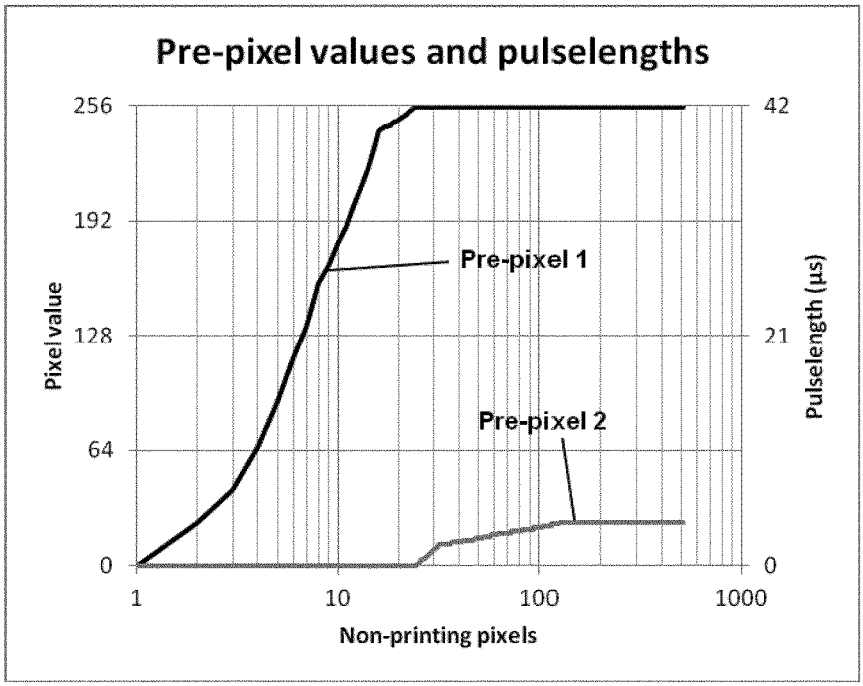
FIG. 9 illustrates, graphically, pre-pixel values and pulse lengths for compensating the delays in ejection.

The patterns A & B are then reprinted at the same print speed applying compensation to the pixel pulse values based on the values from LUT1. In this process the raster image processor (RIP) software generates virtual 'pre-pixels' according to the data in the look-up table LUT1 by scanning along each line of image pixels in the print direction, counting the number of white (non-printing) pixels since the last printing pixel until another printing pixel is reached. LUT1 is then referenced to obtain the start delay value for the associated number of non-printing pixels. The RIP translates start delay into a number of discrete pixel values. In the simplest case, a single pre-pixel is generated whose pulse value represents a pulse length identical to the start delay value in LUT1. For delays of longer than a pixel period, the first pre-pixel pulse is set to the maximum length (value 255) and a second pre-pixel is generated immediately preceding the first with a pulse length that is the difference between the delay and the first pre-pixel length, so that the sum of the two discrete pre-pixel pulse lengths is equal to the associated LUT1 delay value. This may extend to a third or further pre-pixel pulses as necessary. This scheme is shown in the plots of FIG. 9 for compensating the delays measured above, where the test pattern speed and the print speed were equal. Note that pre-pixel 1 immediately precedes the first printing pixel and pre-pixel 2 immediately precedes pre-pixel 1.

Next, the start-up positions of pattern A are re-measured to ensure that they form a straight line and that the single-pixel dashes of pattern B are uniformly printed. Image B is a more sensitive measure of the correct calibration of the method. If there is non-uniformity between the single-pixel dashes, the values of the measured position delay stored in LUT1 can be iterated and the patterns reprinted until uniformity meets the desired level.

If the printhead is to be used for greyscale printing, it is advantageous to print test pattern B using the minimum grey level dot size and iterate the values of LUT1 to achieve uniform printing of the dashes at this grey-level. This is done for two reasons: firstly, the printing of low grey levels has been found to be more sensitive than higher levels to calibration of history effects and, secondly, the most common areas of a photographic style image in which history compensation will be invoked are areas composed of distributions of the minimum grey-level pixels and non-printing pixels. Such areas arise from the process of screening of a continuous-tone greyscale image to be rendered from a number of discrete dot sizes. If $D_{min}$ is the optical density of a printed area where all pixels are printed with the minimum chosen dot size, then areas with density less than $D_{min}$ (paler tones) will be composed of patterns or randomised distributions of the minimum dot size and non-printing pixels, whereas areas with density greater than $D_{min}$ (darker tones) will generally consist of distributions of two neighbouring dot sizes with no non-printing pixels. Hence, history compensation may be invoked in the former distributions because of the unprinted pixels and likely not in the latter distributions which have no unprinted pixels. Using the minimum greylevel to print test pattern B therefore provides the most accurate calibration of the technique.

Figure 10:
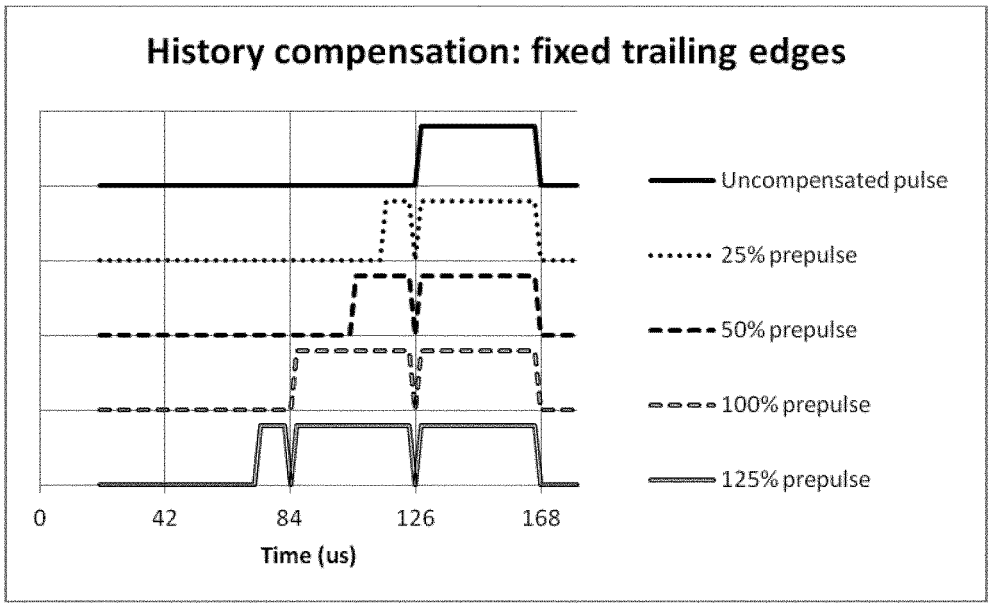
FIG. 10 shows a range of different pre-pulse timings which may be required for a compensation scheme which generates pre-pulses with fixed trailing edge positions and variable leading edge positions to control the pulse length.

The process described above for creating pre-pixel pulses that sum to the start delay in this way is appropriate for a pulsing scheme that generates pre-pulses with fixed trailing edge positions and variable leading edge positions to control the pulse length. As the correction value increases, the leading edge advances until a full-length pre-pulse is reached; a further increase in the correction value generates a second pre-pulse before the first, which is discrete but contiguous with the first and extends further forwards. This is illustrated in FIG. 10, which shows a range of different pre-pulse timings that may be required.

Figure 11:
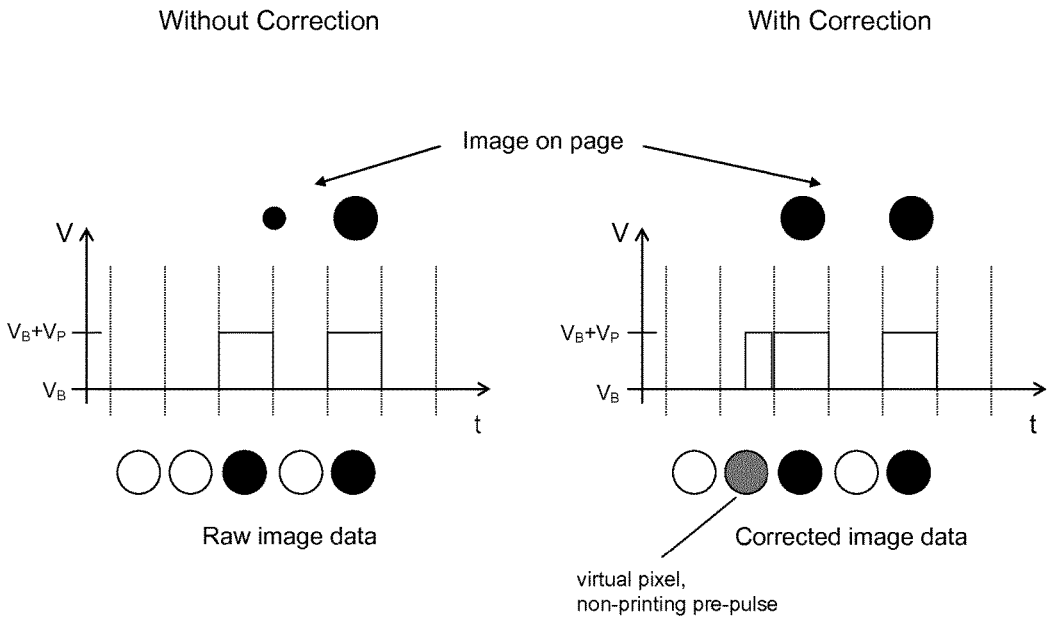
FIG. 11 shows, diagrammatically, the effects of printing both with and without correction of start-up effects.

The end result of the start-up calibration process can be seen by the illustration in FIG. 11. This figure shows, diagrammatically, the effects of printing both with and without correction of start-up, and shows a first and second drop (left to right) in time against pulse value. Without correction the first drop ejected is delayed with respect to the drive pulse and is smaller. With correction a pre-pulse is applied before the first main pulse to compensate for the fact that the channel has been 'off' for a period of time. The second main pulse has the same duration as the first main pulse and prints a dot of the same size as the first main pulse and pre-pulse combined. The correction can be considered as a 'virtual pixel' of reduced greyscale that generates the pre-pulse, but does not create its own ejection event.

Figure 12:
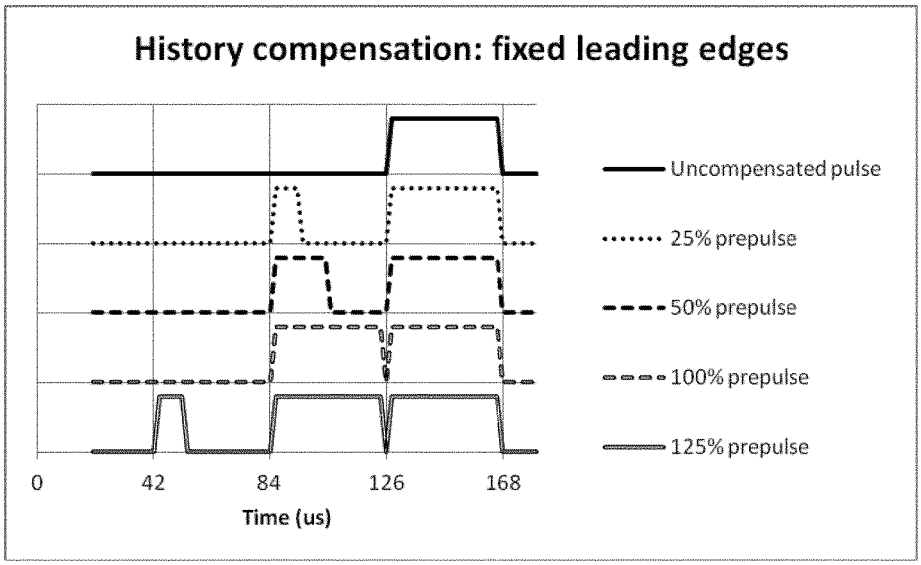
FIG. 12 shows a range of different pre-pulse timings which may be required for a compensation scheme which generates pre-pulses with fixed leading edge positions and variable trailing edge positions to control the pulse length.
Figure 13:
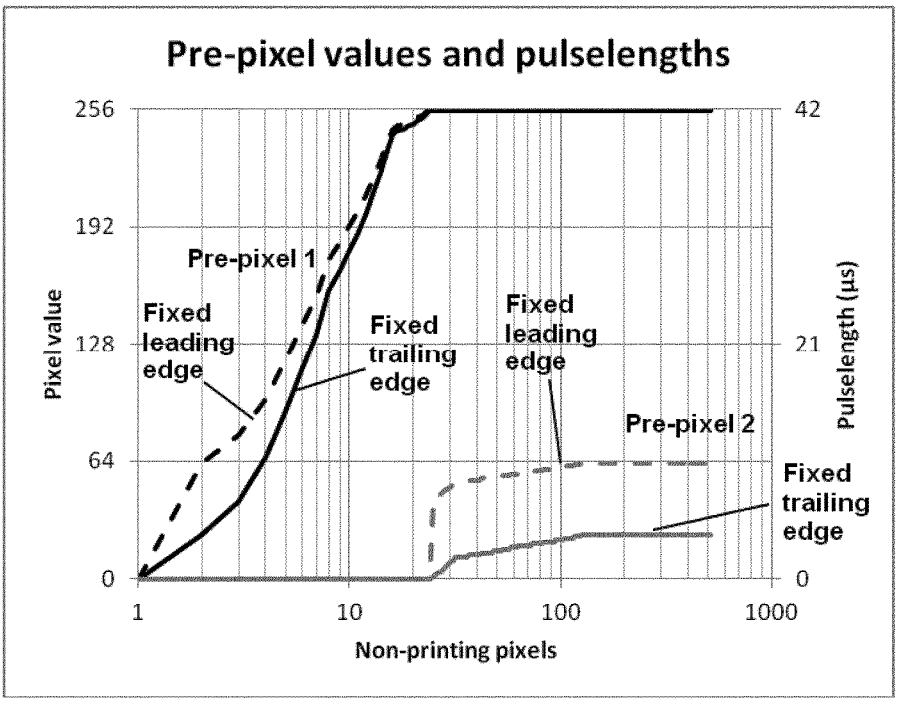
FIG. 13 shows an example of the equivalent pre-pixel values for this scheme compared with FIG. 9.

The technique is not limited to the particular pulsing scheme described and will work equally well if pulses are aligned at their leading edges or centres for example, albeit that an adjustment is made to the pre-pixel pulse values to account for the resulting space between pulses of less than full length. Hence a different set of pre-pulse lengths will achieve the same compensation under different pulsing schemes. For example, a leading-edge-synchronised scheme (as illustrated in FIG. 12) will amplify the length of a short pre-pulse to account for the off-time between the pre-pulse and the print pulse, and progressively reduce that amplification as the pre-pulse length increases towards the maximum. The resultant gaps in the pulse-train shown in FIG. 12 would otherwise cause under-compensation to the start of printing, but can be just as effective as the scheme first described if this adjustment is made to the pre-pixel pulse values to account for the resulting space between pre-pulses of less than full length. The dashed plots illustrated in FIG. 13 show an example of the equivalent pre-pixel values for this scheme compared with the previous scheme. The dashed lines show pre-pixel values for a pulsing scheme where the leading edges are fixed and the trailing edge position varies with the pulse length. Note that at short pulse lengths the value is increased in comparison with FIG. 9 to compensate the off time between the pre-pulse and the next pre- or printing pulse.

A variation of the process that is advantageous for grey-scale printing involves limiting the value of the compensating pre-pixels to less than or equal to the value of the printing pixel that follows the non-printing space (the 'target' pixel). This has been found to be advantageous to the reproduction of pale areas of print that consist of distributions of the minimum greylevel dot-size chosen to render the image, as described earlier.

Figure 14:
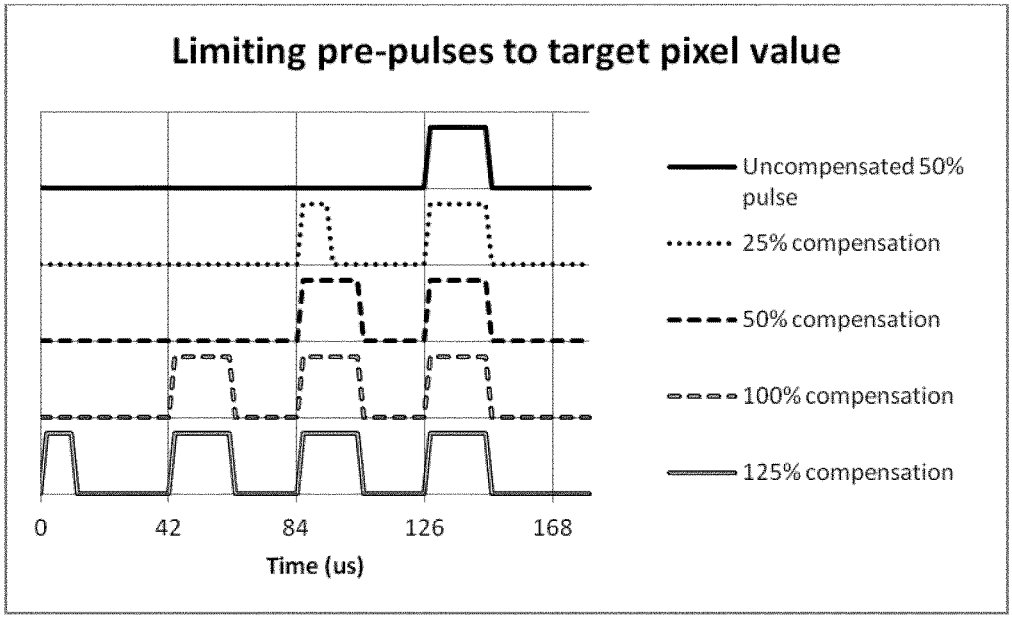
FIG. 14 shows a range of different pre-pulse timings which may be generated for a compensation scheme which limits the value of the pre-pulses to that of the printed pixel that they precede.

In this variation of the process, the way in which the delay values held in LUT1 are translated into pre-pulses is the same as described earlier, except that the maximum permitted value for any compensating pre-pixel is determined by the target pixel and not the value of 255. According to this schema (and using the case where the maximum pre-pixel is equal to the target pixel value) the first pre-pixel is generated using the compensation value from LUT1 in the normal way, except if the LUT1 value is greater than the target pixel value, in which case the first pre-pixel is assigned the target pixel value and the remainder of the compensation value is used to generate the second pre-pixel; if this also reaches the value of the target pixel, a third pre-pixel is generated, and so on. The result is a series of pre-pixels that are generally greater in number, but smaller in value than in the previously described schema, as illustrated in FIG. 14.

Because pre-pixel pulses resulting from this schema are not contiguous in time, an adjustment to the pre-pixel pulse values may be made to prevent discontinuities in the compensation occurring as one pre-pulse extends to two, two extends to three, and so on. This involves increasing the values of short pre-pulses in a way similar to the fixed leading edge example illustrated in FIG. 13.

To achieve good calibration of this schema, the printing of test pattern B (or similar pattern of equivalent function) is performed at the minimum grey level using this compensation method and the values of LUT1 iterated if necessary to produce uniform printing of the single-pixel dashes.

Just as a delay in start-up of the ejection can be observed, so a delay in turn-off can exist. That is, a continuation of ejection from a channel after the end of a block of printing, which is chiefly dependent on the strength of ejection from that channel. This may be compensated by reducing the value of the final pixel before turn-off dependent on the recent history of print pulses to that channel.

Figures 15, 16:
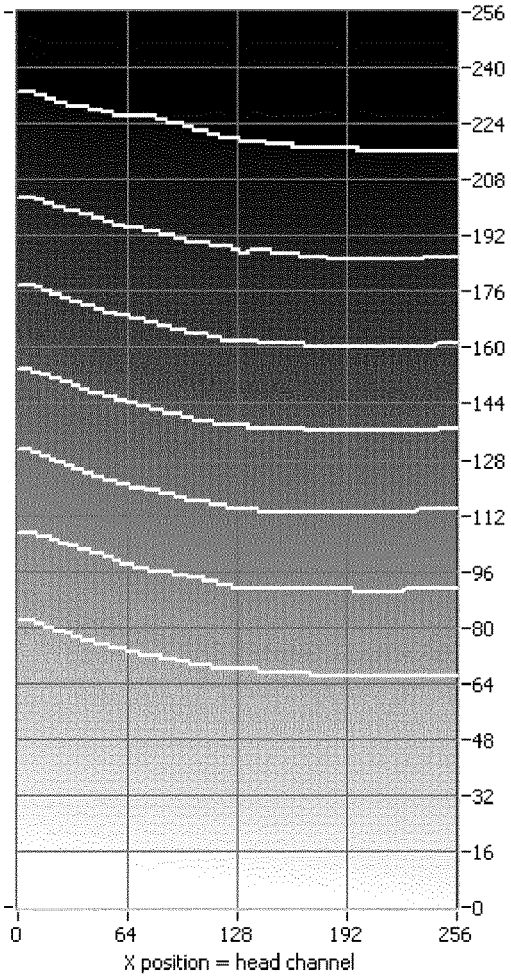
FIG. 15 is a look-up table relating the distance that a printed bar continues printing into white space beyond its intended stop position to the number of printed pixels in the bar.
FIG. 16 shows a family of curves of pulse length versus printhead channel number comprising one curve for each grey level of a calibration method according to application EP12184681.0.

This process may be considered the inverse of the start-up correction and may be calibrated in a similar way but using an inverted form of the test patterns of FIGS. 6A and 6B. Thus printed bars of a range of lengths in the print direction are followed by an area of non-printed white space. The printing of these test patterns is performed using correction for start-up delay to ensure that the printed bars are correctly formed. The distance that a printed bar continues printing into the white space beyond its intended stop position is measured and recorded to a look-up table LUT2 (see FIG. 15) that contains values of stop delay (in 8-bit per pixel value) against printing distance (number of contiguous pixels immediately prior to the end of print). In a process similar to compensating the start-up delay, in operation the RIP then searches the bitmap image file for lines of printing pixels in the print direction followed by one or more non-printing pixels, references LUT2 to obtain the value of corresponding stop-delay, and subtracts this from the value of the final printing pixel. If the stop-delay were greater than 255, the final printing pixel would be given value 0 and the penultimate printing pixel would be reduced in value by the difference between the delay value and 255. However in practice the stop-delay values are usually less than 255 so that only the final printing pixel is usually modified by this process.

As for the previously described process for applying LUT1, the RIP scans the unmodified primary image bitmap to identify the pixels to which to apply the stop-delay correction. The respective modifications of pixel values by these two processes are independent, start-up correction only modifying non-printing pixel values and stop-correction only modifying printing pixel values. The modification of pixel values by LUT2 can therefore be applied to the secondary image bitmap values that have already had LUT1 applied.

The compensations described above have all been appropriate for the case where the operational print speed $s_O$ is constant and equal to the speed $s_C$ at which the calibrations were originally performed. However, operational speeds different from the calibration speed can be accommodated by scaling of the LUTs that contain the calibration results, without the need for performing a new calibration. In the simplest case, scaling of LUT1 and LUT2 is achieved by multiplying the values in both columns by the ratio $s_O/s_C$ and interpolating between rows of the subsequent table to produce rows corresponding to integer entries in column 1, which replace the original rows of the table. In practice it may be necessary to scale the columns of the LUTs using more complex functions of $s_O/s_C$ arrived at from measurement of print performance of the system at different speeds. One example is the nth order polynomial expression:

$$\sum_{i=0}^{n} A_i (s_O / s_C)^i$$

Where $A_i$ are constants arrived at from measurement of the print performance. Usually it is sufficient for n in this expression to be no higher than 2.

The compensations described above may be applied uniformly across an entire printhead or may be calibrated independently for smaller sections of the printhead. In the limit, the history-dependent behaviour of individual channels of a printhead may be independently calibrated. This may be achieved with the use of test patterns that have a range of non-printing lengths followed by single pixels and lines of differing grey levels to allow measurement of individual channel characteristics. In such cases the compensation data is held look-up tables that have an additional dimension for channel number or section of the printhead (an example of which is shown in FIG. 18).

Furthermore it has been found that the process of calibrating the steady-state print density uniformity of a printhead as described in European patent application EP12184681.0 yields data which can usefully be applied to the independent calibration of history correction of the channels of a printhead. It has been found that variation in dynamic performance across a printhead follows a similar pattern to the variation in steady-state performance as described in EP12184681.0. It has been found that channel-by-channel compensation of history effects can be successfully achieved by using the print density calibration data to modify the history compensation calibration values for individual channels or groups of channels across a printhead, allowing a single history calibration process performed at one location on a printhead to be used in conjunction with the print density calibration data to estimate the history correction calibration data for channel-dependent history compensation across the whole printhead.

Figure 17:
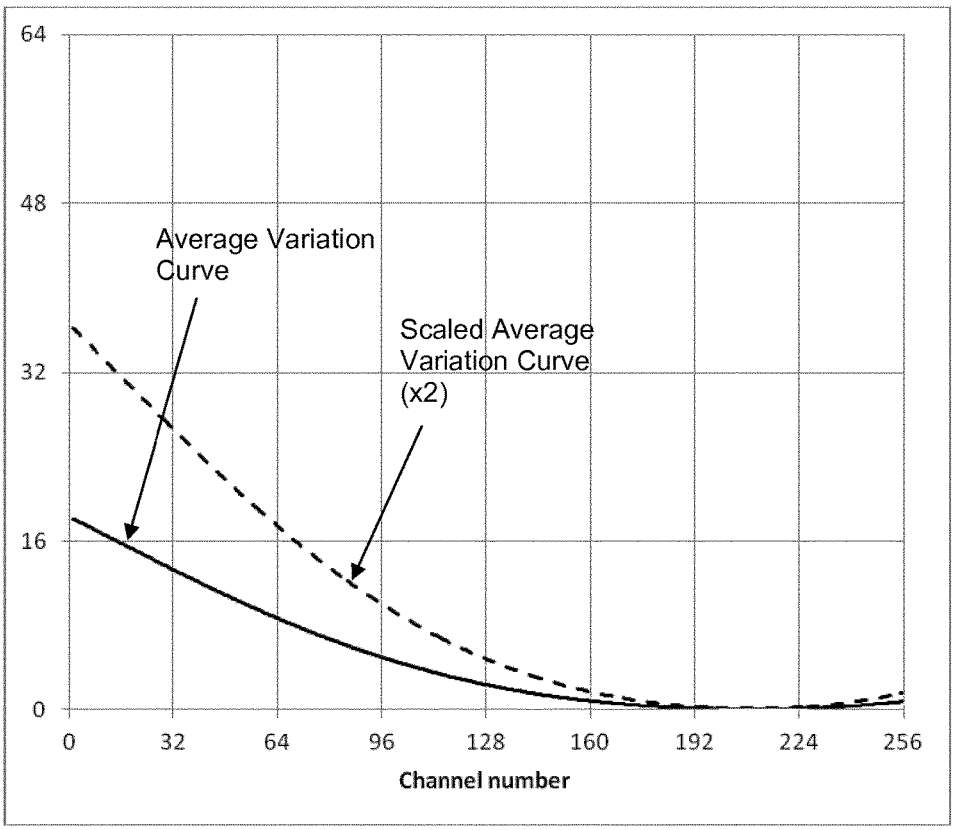
FIG. 17 is a graph illustrating a single average variation curve calculated from this data by averaging the set of curves.

There follows a description of this process which is performed as part of the one-off initial calibration of a printhead. The print density calibration process of EP12184681.0 yields a family of curves of pulse length versus printhead channel number comprising one curve for each grey level (see FIG. 16). For a given printhead, each curve tends to have a similar shape of variation with an approximately constant offset from its neighbouring grey level. A single average variation curve is calculated from this data by averaging the set of curves, smoothing the data to remove any short-range variation, and offsetting the resultant curve so that the position across the printhead at which the LUT1 data was measured is set to zero (usually the strongest part of the printhead is used to obtain the data for LUT1, resulting in the average variation curve being offset so that its minimum is zero and it everywhere takes positive integer values as in FIG. 17, simplifying the mathematical operations on the data). This average variation curve is scaled by an empirically derived constant and added to the start-up correction values held in LUT1. This process results in an addition to the LUT1 values for weaker printing parts of the printhead in proportion to the additional pulse value used to equalise the steady-state print density across the printhead (and a modified look-up table LUT1A—see FIG. 18), and results in good uniformity of start-up and drop-on-demand performance of a printhead.

Figure 19:
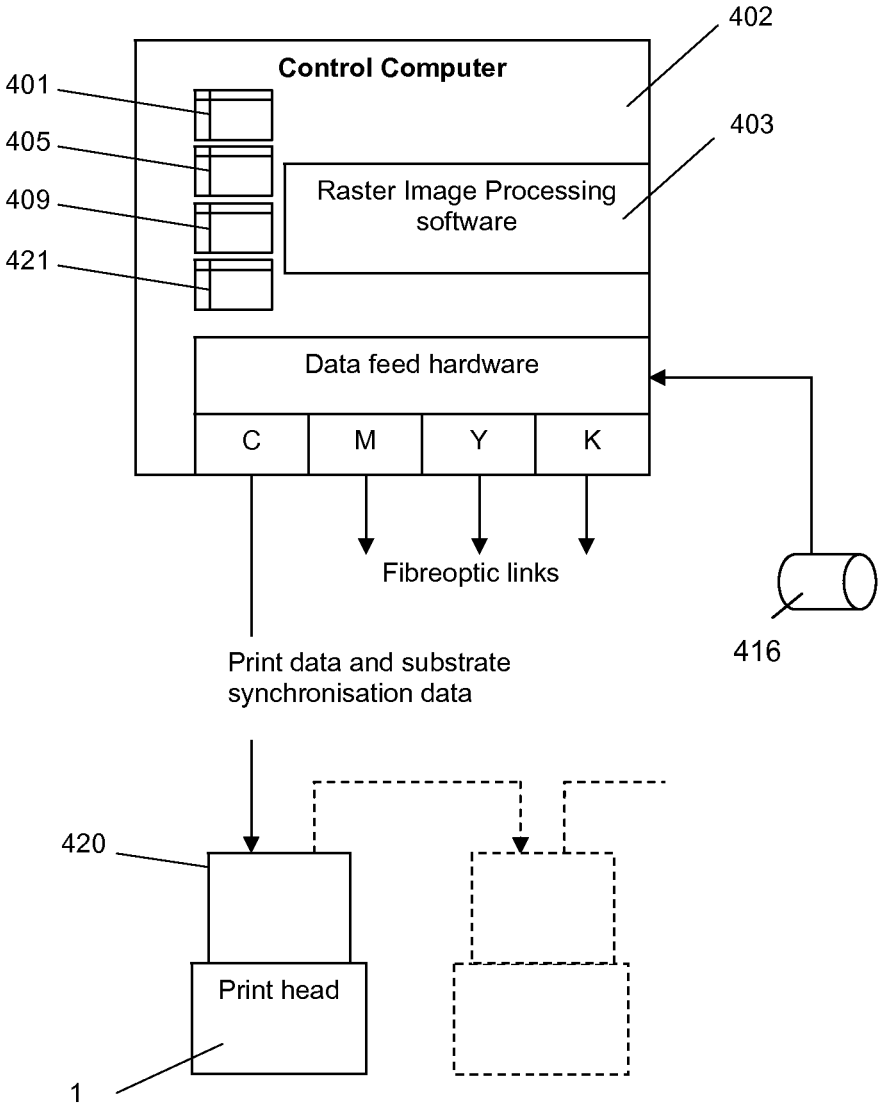
FIG. 19 is a block diagram of some of the printer components used in printing an image from a printer calibrated in accordance with the invention.
Figure 20:
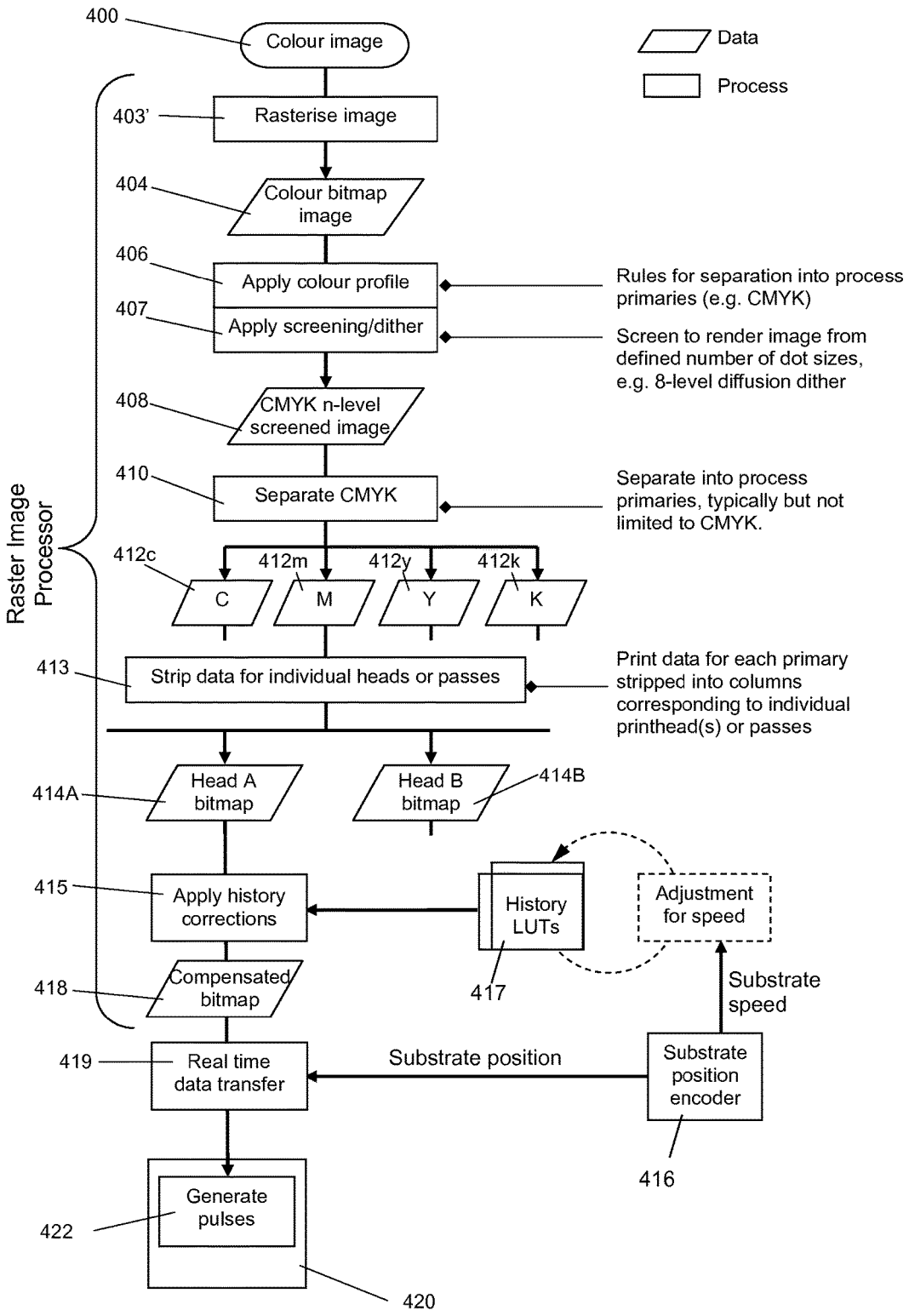
FIG. 20 is a flowchart representing the process of preparing and printing an image after calibration according to the examples described herein

In operation of a printhead calibrated in accordance with the methods described above, as shown in FIGS. 19 and 20, a colour image 400, for example created by using (say) any one of a number of well-known image creation software packages such as Adobe Illustrator, is uploaded into a memory 401 of a computer 402. The initial image 400 is then rasterised (step 403') within the computer 402 using raster image processing software (RIP) 403 and a corresponding colour bitmap image 404 is then created and saved in memory 405. A colour profile is then applied, in step 406, to the bitmap image to apply rules for separation of the colour image into the process primary colours (typically cyan, magenta, yellow and black) and each pixel is then 'screened', in step 407, so that each colour component of the pixel is filtered into one of a number (n) of different 'levels' and the data, representing in this case the CMYK n-level image 408, is then stored in RAM 409 and the individual primary colour components separated, in step 410, into respective data sets 412*c*, 412*m*, 412*y* and 412*k*.

In the case where multiple printheads are employed to print each colour separation, for example where printheads are joined end to end to span a substrate that is wider than the individual head width, or interleaved to provide a greater number of dots-per-inch across the substrate than the spacing of the printhead ejectors, the bitmaps 412 are separated, at step 413, into strips to create data sets 414A, 414B, etc., corresponding to the individual printheads.

In the case where multiple passes of the printhead(s) over the substrate are used to build up the print, the bitmaps 412 are separated, at 413, into strips to create data sets 414A, 414B corresponding to individual passes of the printhead(s).

The bitmap data 414A (only that for the first pass/head A is shown for convenience) is then processed by the RIP software 403 to apply history corrections at step 415 to the head bitmap data 414A based upon the predetermined values of start delay and stop delay held in LUT1 and LUT2 respectively, in step 417. The RIP software does this as described previously by scanning along lines of pixels in the print direction, generating pre-pixels of values determined by LUT1 in response to contiguous sets of non-printing pixels to correct start delay and reducing the values of final pixels in a group of printing pixels as determined by LUT2 to correct for turn-off delay.

For a printer operating at fixed speed equal to the speed at which the initial history calibration was performed, the values held in the look-up tables LUT1 and LUT2 are those values arrived at from the calibration process. In the case of a variable speed printer or a printer operating at a different speed to that at which the calibration test patterns were printed, the values in LUT1 and LUT2 are dynamically updated as previously described according to the measured print speed derived from the substrate position encoder 416.

The history-compensated bitmap data 418 is stored in memory 421. It is subsequently transferred in step 419, according to the relative position of the print substrate and the printheads (as determined by the shaft encoder 416), to the pulse generation electronics 420. Here the incoming bitmap data is used to generate, step 422, voltage pulses of corresponding duration which are applied to the individual printhead ejection channels.

The invention claimed is:

1. A method of printing a two-dimensional bit-mapped raster image having a number of pixels per row, using a printhead having a row of ejection channels, each ejection channel having associated ejection electrodes to which voltages are applied in use, and wherein, during printing, in order to cause volumes of fluid to be ejected from selected ejection channels of the printhead for printing, voltage pulses having values of predetermined amplitude and duration as determined by respective image pixel bit values generated by a raster image processor are applied, at a given pulse period, to the electrodes of the selected ejection channels, wherein the part of the raster image corresponding to an ejection channel is scanned to determine the number of adjacent non-printing pixel periods prior to a pixel to be printed and, immediately prior to the printing of said pixel, a voltage pulse, having a value predetermined in accordance with the time, measured in units of the given pixel period, between the last pixel to be printed and said pixel to be printed, is applied to the ejection electrode.

2. A method according to claim 1, wherein the parts of the raster image corresponding to each ejection channel are scanned to determine the number of adjacent nonprinting pixel periods prior to a pixel to be printed and, immediately prior to the printing of said pixel, a voltage pulse, having a value predetermined in accordance with the time, measured in units of the given pixel period, between the last pixel to be printed and said pixel to be printed, is applied to the corresponding ejection electrode.

3. A method according to claim 1 wherein the time duration of the voltage pulses applied immediately prior to the printing of said pixel are limited to the pixel period or to the pulse length of said pixel.

4. A method according to claim 1, wherein the predetermination of the voltage pulse values is carried out in a calibration process in which one or more printing patterns are printed, each of which contains one or more columns of pixels, comprising continuously printing pixels followed by a number of adjacent nonprinting pixels followed by a further pixel or pixels, in the direction of print (P) that the printhead moves relative to a substrate and which together or individually contain a range of non-printing distances between the continuously printed pixels and the further pixel or pixels.

5. A method according to claim 4, in which the or each printed pattern is scanned and the position of the start of each of said further pixels is determined or measured in relation to a datum position corresponding to the ideal or desired print position.

6. A method according to claim 5, in which the printed pattern is scanned and the position of the start of each said further pixels is determined or measured in relation to a datum position corresponding to the ideal or desired print position for at least one channel of the printhead and estimated for the remaining channels of the printhead.

7. A method according to claim 6, wherein the estimation is calculated from said measurement from the at least one measured channel of the printhead combined with predetermined data for the steady-state print density variation across the printhead.

8. A method according to claim 5, further including an interpolation step carried out by interpolating between the determined or measured values to estimate the start positions for all numbers of non-printing pixels over a predetermined range.

9. A method according to claim 5, wherein the position data, expressed in terms of the 8-bit pulse length value of a pixel (where 0 to 255 represents a pulse of 0 to 100% of the pixel period), is saved to memory in the form of one or more look-up tables relating the number of non-printing pixels to the subsequent start position delay in pixel length value or, respectively, relating the number of printing pixels to the subsequent stop position delay in pixel length value.

10. A method according to claim 9, wherein an operational printing speed differs from the speed at which calibration patterns were printed, and wherein the data held in the look-up table is scaled before being applied to the pixels by multiplying the data values by a function of the ratio operational printing speed/calibration pattern printing speed to produce an intermediate set of values and interpolating between rows of the subsequent table to produce a replacement look-up table having rows corresponding to integer entries which replace the rows of the original table.

11. A method according to claim 9, wherein one or more of the look-up tables is contained in a memory forming part of the printhead.

12. A method according to claim 9, wherein the data in the one or more look-up tables is applied to the pixels of the image to be printed.

13. A method according to claim 1, wherein when a continuous line of pixels is to be printed from an ejection channel in the direction of printing, normal to the direction of the row of ejection channels, the pixel bit values of a preselected number of pixels last to be printed in the line are decreased in accordance with a predetermined calibration schema.

14. A method according to claim 13, wherein the parts of the raster image corresponding to each ejection channel are scanned to determine the number of adjacent printing pixel periods prior to a non-printing pixel and, the pixel bit values of the preselected number of printing pulses applied to the corresponding ejection electrode for the pixels last to be printed prior to the non-printing pixel are reduced in dependence on the number of adjacent printing pixel periods prior to the non-printing pixel.

15. A method according to claim 14, wherein the reduction of the pulse value is predetermined in a calibration process in which one or more printing patterns are printed, each of which contains one or more columns of pixels, comprising continuously printing pixels followed by a non-printing pixel, in the direction of print (P) that the printhead moves relative to a substrate, and which together or individually contain a range of printing distances.

16. A method according to claim 15, in which the or each printed pattern is scanned and the position of the end of each of said pixel last to be printed is determined or measured in relation to a datum position corresponding to the ideal or desired print position.

* * * * *